United States Patent [19]

Maillard et al.

[11] 4,411,116

[45] Oct. 25, 1983

[54] MULTIPLE-USE CHANNEL-SHAPED STRUCTURE FOR SUSPENDED CEILING

[75] Inventors: Laurent Maillard, Milan; Graziano Bregolin, Pavia, both of Italy

[73] Assignee: Thermosystem S.p.A., Italy

[21] Appl. No.: 370,031

[22] Filed: Apr. 20, 1982

[51] Int. Cl.[3] ..... E04B 5/55

[52] U.S. Cl. ..... 52/489; 52/28; 52/220; 52/484; 165/171

[58] Field of Search ..... 52/731, 732, 28, 39, 52/173 R, 220, 484, 738, 739; 55/483, 494; 98/115 R, 115 LH, 115 SB, 115 VM; 165/171

[56] References Cited

U.S. PATENT DOCUMENTS

| | | | |
|---|---|---|---|
| 2,306,685 | 12/1942 | Chambers | 52/28 |
| 2,926,237 | 2/1960 | Sorenson | 52/484 |
| 3,049,199 | 8/1962 | Gruber et al. | 52/220 |
| 3,085,152 | 4/1963 | Schwartz et al. | 52/484 |
| 3,372,740 | 3/1968 | Kastovich et al. | 165/171 |
| 3,426,188 | 2/1969 | Baranowski | 52/484 |
| 3,545,145 | 12/1970 | Yousefpor | 52/28 |
| 3,835,606 | 9/1974 | Liberman | 52/484 |
| 4,233,889 | 11/1980 | Nederman | 98/115 VM |

FOREIGN PATENT DOCUMENTS

| | | | |
|---|---|---|---|
| 919494 | 2/1963 | United Kingdom | 52/220 |

*Primary Examiner*—John E. Murtagh
*Assistant Examiner*—Mark J. Sofia

[57] ABSTRACT

An elongated channel-shaped structure, preferably of anodized extruded aluminium, is suitable to form the load bearing beam of a false ceiling assembly, in particular comprising absolute filters for the so-called "clean rooms". Such a structure is U-shaped and comprises an elongated and uninterrupted central slot or groove for the fixing to the ceiling, with the concavity of the U-shape directed downward, having outer lateral finnings for the cooling, outer grooves and projections for the coupling with transverse spacers and for supporting absolute filters, as well as inner grooves and projections for supporting electric lines, pipes and other devices and systems. There are also provided extension members directed downward, to be fastened to said structure and having further support and guide fit grooves.

5 Claims, 3 Drawing Figures

MULTIPLE-USE CHANNEL-SHAPED STRUCTURE FOR SUSPENDED CEILING

BACKGROUND OF THE INVENTION

The present invention relates to an elongated channel-shaped structure of multiple uses, in particular for supporting absolute filters of a so-called "clean room". This structure, preferably formed of a number of assembled anodized extruded aluminium sections, is adapted to house and support, particularly in combination with transverse depending elongated members and possibly vertical joining elements, all that is required for a suspended ceiling assembly with facilities, especially of a clean room (sterilized, hospital operating room, etc.).

It is known at the height of the ceiling in rooms of industrial premises or designed for public use (i.e. of social, educational, recreative, etc. character) such as hospitals, schools, congress halls, department stores, etc., a great number of systems are installed, being required for the operation of the facilities provided in the same rooms. One could mention for example fundamental facilities such as power and fluids distributing systems and the lighting, as well as the diffusors for air conditioning, the sprinkler system, the loudspeakers and in particular, for the above-mentioned "clean rooms", the so-called absolute filters.

It is known that the function of supporting these systems has been hitherto carried out by means of frames of metal or other material, with square or rectangular cross-section, to be joined together one another and to be adapted each time to the particular problem to be solved. These frames had thereby to be subjected, when mounted on the ceiling, to various operations such as cutting, drilling for the insertion of fastening bolts, possible welding and final sealing along the junctions. In spite of this sealing, made for example by using silicone-based materials, a complete air-tight seal was difficult to be obtained, especially when absolute filters were provided for a clean room, that is a room with extremely high requirements as to the reduction of dust. In any case the necessary adjustment steps during the assemblage and the check operation had required long time and as a consequence high costs, also taking into account the necessary specialized labour required.

SUMMARY OF THE INVENTION

It is the object of the present invention to provide a preformed structure for whichever application of ceiling-suspended systems which does not show the above inconveniences of the prior art frames, as it may be available in practically unlimited or however modular lengths and it can be cut according to the required size and therefore readily installed with simple operations by non-specialized personnel.

Furthermore, the elongated structure of the invention is particularly suitable to support, in co-operation with cross members which provide for the spacing and sealing between the adjacent structures, the absolute filters required for high purity clean rooms.

In co-operation with other dependent elements or "hangers", fixed to vertically extend downwards at the bottom of the U-shaped structure, additional devices and elements designed to be installed at a lower height can be mounted according to the requirements (gratings, wire nets, etc.).

These and further advantages of the present invention are obtained with a channel-shaped elongated and uninterrupted structure, adapted to be mounted to the ceiling with the concavity in the downward direction by means of a central continuous slot, being provided with outer side fins for the cooling and outer grooves for the coupling with cross spacer members as well as inner grooves, and both outer and inner support transverse projections.

According to a particular aspect of the present invention, the present elongated structure is formed of either one extruded element or a plurality of extruded sections being mutually joined such as by bolting already during the manufacture and so assembled carried to the installation place, where they are mounted so as to cover the whole length of the room from a wall to the opposite one in abutment with two metal head plates. Alternatively a number of modular units made of assembled modular extruded sections are connected longitudinally according to their length. It results as a consequence that the use of longitudinal structures according to the invention is the more advantageous for suspended ceilings, the longer is the ceiling and in any case the wider is the surface to be covered, since then the saving of labour and time required for the mounting is more significant.

BRIEF DESCRIPTION OF THE DRAWINGS

The advantages and the features of the structure according to the invention will result more clearly from the following detailed description of an embodiment thereof, given by way of a non-limiting example with reference to the attached drawings in which.

DETAILED DESCRIPTION OF THE PREFERRED EMBODIMENT

Figure 1:
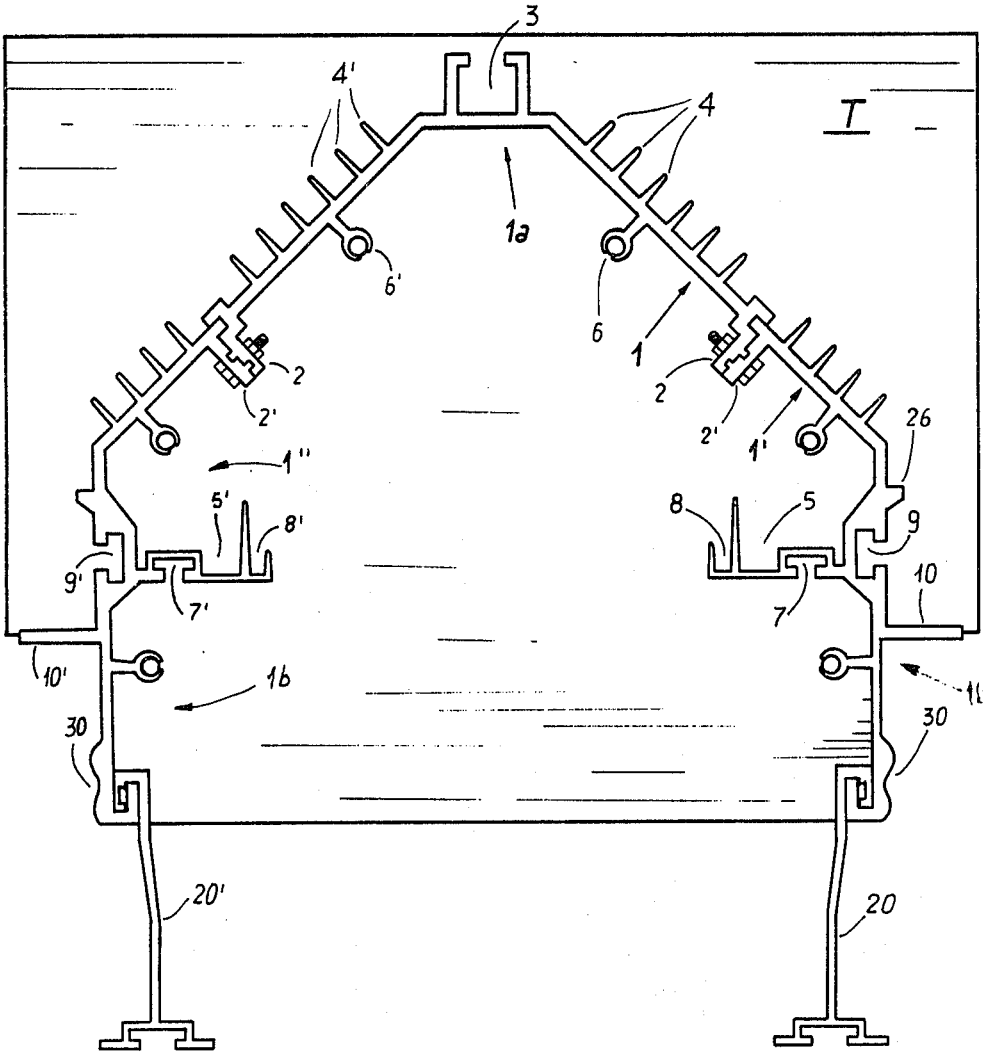
FIG. 1 ia a cross-sectional view of a structure according to the invention.

With reference to the drawings and in particular to FIG. 1, the structure 1 according to the present invention is comprised of a number of longitudinal members, preferably of anodized extruded aluminium, connected each other by bolt junctions at flanges 2, 2' provided for this purpose with all the necessary fittings and seals. Of course the structure 1 could also be made integrally by means of a larger die. The illustrated embodiment shows three of these members, namely a central one **1*a* having substantially a U-shape and two side members 1', 1''**.

These side members are substantially equal and each of them, when has one portion connected and aligned with one of the two side legs of the central member **1*a*, has a second portion 1*b* at a given angle with the first portion, so as to be parallel to the corresponding portion of the other, opposite side member. When so assembled, the structure 1 has a reversed channel U-shape, as it is fixed to the upper structure of the ceiling through an uninterrupted slot 3** provided at the apex of said U-shape.

The central member **1*a*, in addition to said slot or aperture adapted to the insertion of whichever number of fastening bolts heads in any position is desired, has a number of outer fins 4, 4', etc. to enhance the outward dispersion of the generated heat, especially due to the lighting bodies within the structure. Inner grooves 6, 6'** are also provided for the connection with head plates T by means of screws or bolts.

Each portion of the side members 1', 1'' which are a lateral downward extension of the channel structure (or of the lower side portions of the channel when made integral) comprises additional outer fins 4, 4' parallel to those of the adjacent leg of the central member or portion; additional grooves 6, 6', as well as inner recesses and beads 5, 7, 8 for housing and supporting overheat lines for any utilization (power and lighting current, even for emergency cases and line radio or loudspeaker systems) or pipes such as for the automatic sprinkler systems and the relevant sensors for smoke detection. In the particular embodiment shown in FIG. 1, there may be seen in particular the recesses 7, 7' for the housing of spacer elements, and the inwardly projecting beads 8, 8' may be useful as lampholder housing.

According to the present invention each portion 1*b* of the structure on each outer side thereof is characterized by a recess 9, 9' and a lower bracket element 10, 10' for attaching a cross member 11 (FIG. 2) and an absolute filter 12 (FIG. 3), respectively.

Figure 2:
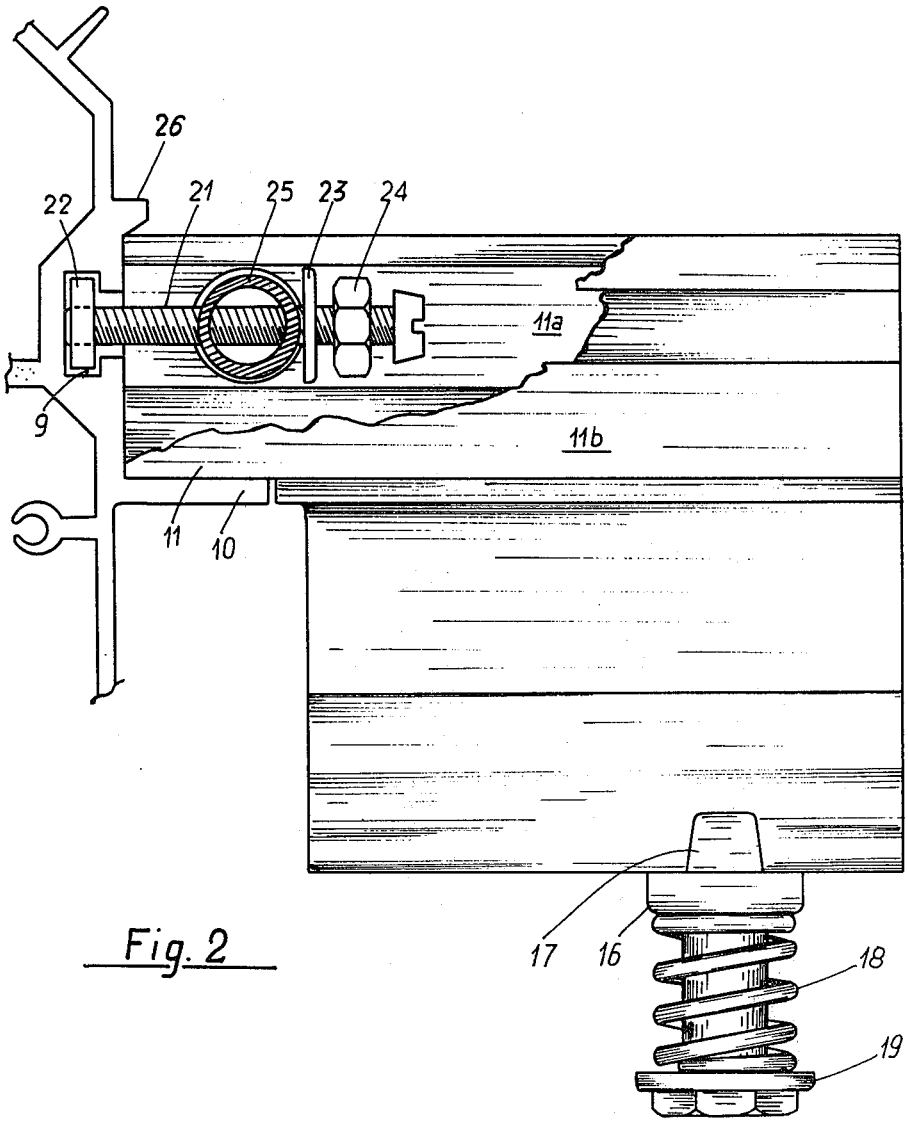
FIG. 2 is a diagrammatic fragmentary view, partly in section of the zone of connection between the structure of FIG. 1 and a cross member associated therewith according to the invention.
Figure 3:
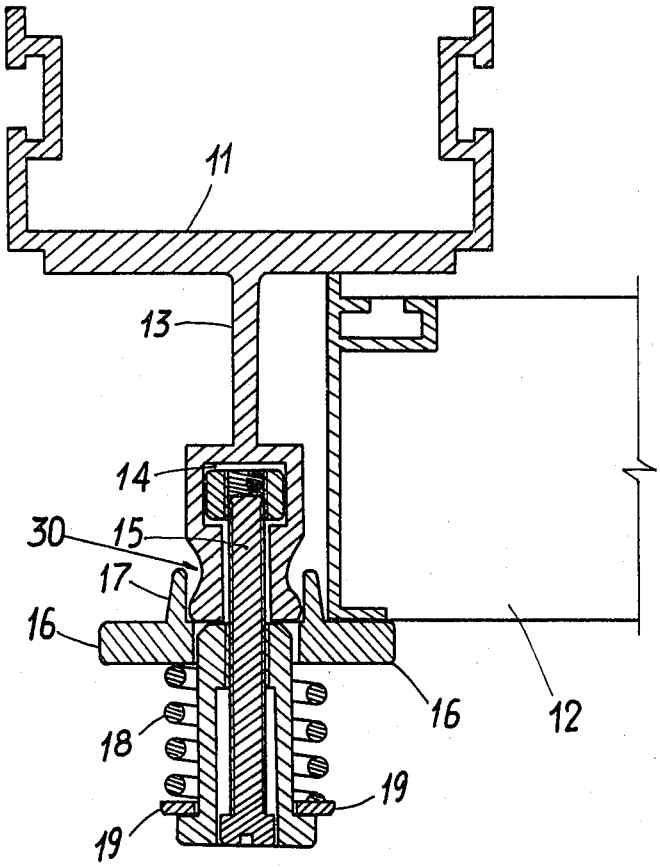
FIG. 3 shows a similar sectional view of the connection with an absolute filter.

With reference to FIG. 2 a preferred design of joining a cross member 11 is shown, with the cross member fixedly attached at either side to a pair of adjacent main beams or channels 1 by means of an assembly comprised of a threaded shank 21 with a slotted head, a small plate 22 previously inserted in said recess 9, a washer 23 and a nut 24. The shank 21 is kept in place by a transverse cylindrical tube 25 which has a hole for the passage of the shank and is mounted in turn in two opposite holes in the side walls 11*a*, 11*b* of the cross member 11. When tightening the nut 24 against the tube 25 through the washer 23, such an assembly functions as a tie rod while keeping the cross member 11 precisely in position, also due to the abutment provided by a projection or ledge 26 on the channel 1, which prevents the cross member from vertical movements. A silicone layer between the cross member 11 and the bracket element 10 ensures a complete air-tight seal.

Each cross member 11 has the function of a spacer and connection between two adjacent main structures 1 and is formed, in addition to a planar zone between the two walls 11*a*, 11*b*, with a portion 13 perpendicular thereto which, upon mounting the cross member 11, is directed downwards. The portion 13 is fork-shaped at the lower end so as to form a counterbored recess 14 for housing the head and the shank of a fastening bolt 15 to secure an absolute filter 12 at each side of the adjacent channel-shaped structures, between the bottom face of the planar zone of the cross member 11 and a lower stop element 16. Said bolt 15 is a part of a chuck device for mounting the absolute filters 12, also comprising a resilient member such as a compression helicoidal spring 18 between the stop plate 16 and a ring nut 19 to be screwed at the bottom end of the bolt. The mounting is effected by previously assembling the chuck device, then inserting the filter 12 between the stop 16 and the lower face of the cross member 11, and adjusting the filter in the width sense by means of a vertical tooth 17 formed on the stop plate 16, at both the sides of the bolt, the stop plate being holed for allowing the bolt to pass therethrough. Thereafter the assembly is tightened by applying a pre-determined force to the seal gaskets of the filter, while it is possible to obtain a possible taking up of the slack due to the aging, thus ensuring a reliable seal in the time, by a suitable action on the ring nut 19 and consequent variation of the resilient force applied.

With this arrangement more than one chuck device for each filter 12 can be provided according to its length and generally the type of filter used. The two teeth or vertical stops 17 prevent the plate 16 from rotating and ensure its positioning.

Coming now back to FIG. 1, the lower end of each side of the structure 1 is adapted to support in any known manner a "hanger" or dependent section 20, 20' being its continuation downwards. Each section 20, 20' is formed e.g. with inner oppositely facing recesses, so as to support possible gratings, conditioning air diffusers such as of the laminar type, punched metal plates or panels, plates made of layers of methacrylic resins for supporting loudspeakers, smoke detectors, sprinkler heads for antifire systems, emergency lamps, etc. Preferably they have also an end groove, in the downward direction which is designed for the coupling of partition walls, panels in general and all that is necessary for confining zones or rooms, posts and vertical boards.

It should be considered that, in order to enhance the mutual seal of the silicone-based materials employed, some zones of the main structure 1 and the cross member 11 are shaped as in 30 and 30'.

Additions and/or variations could be provided in the above-mentioned and illustrated embodiment of the structure according to the present invention without exceeding the scope of the invention itself, as defined in the appended claims.

What we claim is:

1. A multiple-use channel-shaped structure for false ceilings to be fixed at the ends to a pair of head plates, in particular for supporting absolute filters, which is channel-shaped, elongated and uninterrupted, adapted to be mounted to the ceiling with the channel-shaped concavity in the downward direction by means of a central continuous slot, further comprising outer cooling fins and outer recesses for the connection with cross spacer members; inner grooves for coupling with said head plates; supporting inner recesses and beads; and outer brackets for supporting said absolute filters.

2. A structure according to claim 1 being formed of three anodized extruded aluminium sections, one central of which is substantially U-shaped and has said central slot; and two side ones which comprise a first portion being substantially the continuation of said central section, and a second portion being substantially parallel to a symmetry plane of the structure, there being also provided flanges with fittings and seals for a connection between said central section and said side ones.

3. A structure according to claim 1, further comprising coupling means for uninterrupted fixing of a substantially vertical section to each lower end of the structure, said vertical section being also provided with inner recesses and a continuous profiled groove directed downwards.

4. A structure according to claim 1 further comprising, for fixing said cross spacer member a taking up assembly comprising a first bolt with threaded shank, head and polygonal plate to be inserted into one of said outer recesses; a tubular member with throughhole in the cross-section direction for the insertion into opposite housings formed in side walls of the cross members; and a nut and washer unit for positioning and tightening the assembly.

5. A structure according to claim 1, further comprising for fixing absolute filters a chuck device comprising a second bolt with threaded shank and a nut to be inserted in a counterbored recess formed in a vertical central wall of the cross member, and having a ring nut screwable at the opposite end of the shank and a spring element compressed between the ring nut and an apertured stop plate for supporting the filter, said stop plate having also two vertical side teeth which prevent the same from rotating.

* * * * *